US008246898B2

(12) United States Patent
Conrad et al.

(10) Patent No.: US 8,246,898 B2
(45) Date of Patent: Aug. 21, 2012

(54) METHOD AND APPARATUS FOR ENHANCED FIBER BUNDLE DISPERSION WITH A DIVERGENT FIBER DRAW UNIT

(76) Inventors: John H. Conrad, Alpharetta, GA (US); Eric E. Lennon, Roswell, GA (US); Douglas J. Hulslander, Atlanta, GA (US); Joerg Hendrix, Alpharetta, GA (US); Detlef Frey, Niederkassel (DE)

( * ) Notice: Subject to any disclaimer, the term of this patent is extended or adjusted under 35 U.S.C. 154(b) by 375 days.

(21) Appl. No.: 11/725,593

(22) Filed: Mar. 19, 2007

(65) Prior Publication Data

US 2008/0230943 A1 Sep. 25, 2008

(51) Int. Cl.
*B29C 47/00* (2006.01)
*B28C 5/00* (2006.01)

(52) U.S. Cl. ..... 264/555; 264/103; 264/518; 264/121; 424/174.8 R; 424/81.1; 424/83.1

(58) Field of Classification Search ..... 264/555, 264/518, 121, 103; 425/174.8 R, 81.1, 83.1
See application file for complete search history.

(56) References Cited

U.S. PATENT DOCUMENTS

| | | | | |
|---|---|---|---|---|
| 3,325,906 | A | 6/1967 | Franke | |
| 3,334,161 | A | 8/1967 | De Guzman | |
| 3,692,618 | A | 9/1972 | Dorschner et al. | |
| 3,802,817 | A | 4/1974 | Matsuki et al. | |
| 4,186,463 | A * | 2/1980 | Marshall | 19/304 |
| 4,209,563 | A | 6/1980 | Sisson | |
| 4,263,241 | A | 4/1981 | Alexandrov et al. | |
| 4,322,027 | A | 3/1982 | Reba | |
| 4,340,563 | A | 7/1982 | Appel et al. | |
| 4,350,482 | A | 9/1982 | Alexandrov et al. | |
| 4,405,297 | A | 9/1983 | Appel et al. | |
| 4,627,811 | A | 12/1986 | Greiser et al. | |
| 4,692,106 | A | 9/1987 | Grabowski et al. | |
| 4,820,142 | A * | 4/1989 | Balk | 348/97 |
| 4,820,459 | A | 4/1989 | Reifenhauser | |
| 4,838,774 | A | 6/1989 | Balk | |
| 5,141,700 | A | 8/1992 | Sze | |

(Continued)

FOREIGN PATENT DOCUMENTS

WO WO 03/012179 2/2003

(Continued)

OTHER PUBLICATIONS

Patent Abstracts of Japan No. 2002371428, Dec. 26, 2002.

(Continued)

*Primary Examiner* — Joseph Del Sole
*Assistant Examiner* — Nahida Sultana
(74) *Attorney, Agent, or Firm* — Dority & Manning, P.A.

(57) ABSTRACT

A method and associated apparatus for melt extruding a nonwoven web includes providing a plurality of fibers from an extrusion device. The fibers are conveyed through a diverging profile portion of a fiber drawing unit (FDU) that causes the fibers to spread and expand in the machine direction within the FDU. The fibers are then conveyed through a diverging diffusion chamber spaced from the outlet of the FDU to reduce the velocity of the fibers and further spread the fibers in the machine direction. The fibers may be subjected to an applied electrostatic charge in either the diffusion chamber or the FDU. From the outlet of the diffusion chamber, the fibers are laid onto a forming surface as a nonwoven web.

19 Claims, 6 Drawing Sheets

U.S. PATENT DOCUMENTS 5,208,098 A 5/1993 Stover
5,460,500 A 10/1995 Geus et al.
5,482,772 A 1/1996 Strack et al.
5,545,371 A 8/1996 Lu
5,558,713 A * 9/1996 Siegfried et al. ..... 118/308
5,571,537 A 11/1996 Geus et al.
5,599,488 A 2/1997 Profe
5,648,041 A * 7/1997 Rodgers et al. ..... 264/555
5,667,749 A 9/1997 Lau et al.
5,695,377 A 12/1997 Triebes et al.
5,707,468 A 1/1998 Arnold et al.
5,711,970 A 1/1998 Lau et al.
5,714,171 A 2/1998 Profe
5,762,857 A * 6/1998 Weng et al. ..... 264/465
5,800,840 A 9/1998 Geus et al.
5,807,795 A 9/1998 Lau et al.
5,811,178 A 9/1998 Adam et al.
5,814,349 A 9/1998 Geus et al.
5,988,522 A 11/1999 Glezer et al.
5,989,004 A 11/1999 Cook
6,183,684 B1 2/2001 Lu
6,379,136 B1 4/2002 Najour et al.
6,468,063 B1 10/2002 Kobayashi et al.
6,607,624 B2 8/2003 Berrigan et al.
6,692,601 B2 2/2004 Najour et al.
6,709,623 B2 3/2004 Haynes et al.
6,737,009 B2 5/2004 Taylor et al.
6,783,722 B2 8/2004 Taylor
6,799,957 B2 10/2004 Allen
6,824,372 B2 11/2004 Berrigan et al.
6,918,750 B2 * 7/2005 Geus et al. ..... 425/66
6,932,590 B2 8/2005 Geus et al.
6,966,762 B1 11/2005 Maggio et al.
6,974,316 B2 12/2005 Maggio
6,979,186 B2 12/2005 Schmit et al.
6,989,125 B2 1/2006 Boney et al.
7,008,205 B2 3/2006 Schmit
7,014,441 B2 3/2006 Haynes et al.
7,470,389 B2 * 12/2008 Berrigan et al. ..... 264/555
7,504,060 B2 * 3/2009 Brock et al. ..... 264/465
7,740,777 B2 * 6/2010 Wilkie et al. ..... 264/103
7,762,800 B2 * 7/2010 Geus et al. ..... 425/66
7,780,903 B2 * 8/2010 Topolkaraev et al. ..... 264/555
8,057,205 B2 * 11/2011 Hisada et al. ..... 425/66
8,137,088 B2 * 3/2012 Boscolo et al. ..... 425/72.2
2003/0030191 A1 * 2/2003 Davis et al. ..... 264/555
2003/0114066 A1 6/2003 Clark
2003/0233735 A1 12/2003 Haynes et al.
2004/0028763 A1 2/2004 Schmit et al.
2004/0116018 A1 6/2004 Fenwick et al.
2004/0198124 A1 10/2004 Polanco et al.
2005/0023711 A1 2/2005 Allen
2005/0082723 A1 4/2005 Brock et al.
2005/0087287 A1 * 4/2005 Lennon et al. ..... 156/167
2005/0087288 A1 4/2005 Haynes et al.
2005/0087900 A1 4/2005 Allen et al.
2005/0104261 A1 5/2005 Allen et al.
2005/0140067 A1 * 6/2005 Berrigan et al. ..... 264/518
2006/0049549 A1 3/2006 Moller et al.
2006/0082012 A1 * 4/2006 Webb et al. ..... 264/172.12
2006/0172024 A1 8/2006 Bentley et al.
2007/0222099 A1 * 9/2007 Wilkie et al. ..... 264/103
2010/0062672 A1 * 3/2010 Fare' ..... 442/409
2010/0310084 A1 * 12/2010 Hersbach ..... 381/71.6
2011/0059669 A1 * 3/2011 He et al. ..... 442/415
2012/0040582 A1 * 2/2012 Topolkaraev et al. ..... 442/334

FOREIGN PATENT DOCUMENTS

WO WO 03/038174 5/2003
WO WO 2004/104485 12/2004
WO WO 2005/052238 6/2005

OTHER PUBLICATIONS

EPO Search Report, Jul. 30, 2008.

* cited by examiner

METHOD AND APPARATUS FOR ENHANCED FIBER BUNDLE DISPERSION WITH A DIVERGENT FIBER DRAW UNIT

TECHNICAL FIELD

The present invention relates to a method for forming nonwoven webs, and to an apparatus for forming such webs.

BACKGROUND OF THE INVENTION

Melt extruded nonwoven webs have many uses, including medical care garments and products, protective wear garments, mortuary and veterinary products, and personal care products. For these applications, nonwoven fibrous webs provide tactile, comfort and aesthetic properties that approach those of traditional woven or knitted cloth materials. Nonwoven web materials are also widely utilized as filtration media for both liquid and gas or air filtration applications since they can be formed into a filter mesh of fine fibers having a low average pore size suitable for trapping particulate matter while still having a low pressure drop across the mesh.

Melt extrusion processes for spinning continuous filament yarns, filaments or fibers such as spunbond fibers, and for spinning microfibers such as meltblown fibers, are well known in the art, as are the associated processes for forming nonwoven webs or fabrics therefrom. Typically, fibrous nonwoven webs such as spunbond nonwoven webs are formed with a fiber extrusion apparatus, such as a spinneret, and fiber attenuating apparatus, such as a fiber drawing unit (FDU), oriented in the cross-machine direction ("CD"). That is, the apparatus is oriented at a 90-degree angle to the direction of web production (the "machine direction" or "MD"). Although the fibers are laid on the forming surface in a generally random manner, still, because the fibers exit the CD oriented spinneret and FDU and are deposited on the MD-moving forming surface, the resulting nonwoven webs have an overall average fiber directionality wherein more of the fibers are oriented in the MD than in the CD. A fiber diffuser may be positioned below the FDU to reduce the fiber velocity prior to laying the fibers onto the forming surface. It is widely recognized that such properties as material tensile strength, porosity, permeability, extensibility and material barrier, for example, are a function of the material uniformity and the directionality of the fibers or filaments in the web.

Various attempts have been made to distribute the fibers or filaments within the web in a controlled manner, attempts including the use of electrostatics to impart a charge to the fibers or filaments, the use of spreader devices to direct the fibers or filaments in a desired orientation, the use of mechanical deflection means for the same purpose, and reorienting the fiber forming means. For example, WO 2005/045116 describes a method an apparatus for the production of nonwoven web materials wherein the fibers are attenuated with a fiber drawing unit and the velocity of the fibers is reduced in a downstream diffusion chamber defined between opposed diverging sidewalls. An electrostatic charge is applied to the fibers either before they enter the diffusion chamber or within the diffusion chamber by two or more oppositely directed electrostatic charging units.

WO 02/052071 describes a method and apparatus for the production of nonwoven web materials wherein the fibers are subjected to an electrostatic charge and then directed to a deflector device while under the influence of the charge. The fibers are then collected on a forming surface to form the nonwoven web. The deflector device may include a series of teeth separated by a distance determined by the desired orientation of the fibers in the nonwoven web.

The art is continuously seeking improved methods and devices to still further improve the process of distributing the fibers in melt extrusion processes to achieve superior nonwoven materials. The present invention relates to such an improved method and apparatus.

SUMMARY OF THE INVENTION

Objects and advantages of the invention will be set forth in part in the following description, or may be obvious from the description, or may be learned through practice of the invention.

The present invention provides a method and related apparatus for making a nonwoven web, the method including the step of providing a plurality of fibers from an open melt extrusion system. After leaving an extruder device, such as a conventional spinneret, the fibers may be quenched and then subjected to a pneumatic attenuation force by a drawing slot of a separate fiber draw unit (FDU) having an inlet and an outlet, the attenuation force imparting a velocity to the fibers and causing the fibers to be attenuated (reduced in diameter) in the quench zone. In an open type of system, the quench air is provided by one or more blowers, and the pneumatic attenuation force may be generated within the separate FDU by any combination of air nozzles or plenums (referred to collectively as air nozzles) that direct relatively high velocity aspirating air through the drawing slot. In a closed system, the FDU is generally combined with the quench air housing such that the quench air also serves as the attenuating air. In certain configurations of the FDU, some degree of attenuation of the fibers may occur in the FDU as well.

It may be desired to pertubate the attenuating airstreams within the drawing slot of the FDU to further improve the machine direction bundle spread of the fiber bundle. This may be done, for example, by alternately pulsing the air from the air nozzles in the opposite walls of the FDU. This feature may be accomplished with single or multiple air nozzles in the respective FDU walls.

From the FDU, the fibers are conveyed through a diverging diffusion chamber spaced from the outlet of the FDU wherein the velocity of the fibers is reduced. The fibers may also be subjected to an applied electrostatic charge in either the diffusion chamber or the FDU. The fibers exit the diffusion chamber and are collected as a web on a moving forming surface.

Linear drawing devices, slot drawing and fiber drawing units that utilize high velocity jets to impart the draw forces on the fibers are known to compress or densify the fiber bundle in the fiber/air stream. This densified or compressed fiber bundle then needs to be expanded in order to form the desired web. Diffusion devices and other types of fiber deflectors or spreading devices and electrostatics are used to expand the fibers to ensure a high level of dispersion prior to the web forming process.

A unique feature of the method and apparatus of the invention includes conveying the fibers through a diverging profile portion of the FDU drawing slot to expand and spread the fibers in the machine direction within the FDU. The diverging profile causes the fiber bundle to expand and spread in the machine direction within the drawing slot prior to the inlet of the diffuser. This machine direction spreading of the fiber bundle within the FDU in combination with a diverging diffuser results in improved web formation as compared to straight drawing slots (parallel sidewalls) or converging drawing slots (converging sidewalls) under comparable processing parameters.

The diverging profile portion of the FDU drawing slot may take on various shapes. In one embodiment, the diverging portion is defined by symmetrically diverging sidewalls (curved, straight, or a combination thereof) of the FDU such that a symmetric divergence angle is defined with respect to the longitudinal centerline of the drawing slot. In an alternate embodiment, the diverging portion is defined by asymmetrically diverging sidewalls, or one diverging sidewall. The diverging portion of the drawing slot may diverge substantially continuously (at a constant or varying rate) from a minimum width to a maximum width. Alternatively, the diverging portion may diverge in a discontinuous manner (e.g., stepwise) between the minimum and maximum width The diverging profile portion of the FDU drawing slot may encompass the total longitudinal length of the drawing slot. For example, the drawing slot may diverge from a minimum width at the inlet of the drawing slot to a maximum width at the outlet of the drawing slot. In different embodiments, the diverging profile portion may be defined only in a portion of the overall length of the drawing slot. For example, the FDU drawing slot may include an upstream (with reference to the direction of fiber travel) non-diverging portion adjacent to the diverging profile portion. This non-diverging portion may have essentially parallel sidewalls, or converging sidewalls.

The diverging profile portion of the FDU may be defined by curved wall sections, straight wall sections, or a combination of curved and straight wall sections.

Similar to the diverging profile portion of the FDU drawing slot, the diverging diffusion chamber may be defined by symmetrically or asymmetrically diverging sidewalls.

In a particular embodiment, the electrostatic charge is applied to the fibers as the fibers are conveyed through the FDU drawing slot by one or more electrostatic charging units. For example, the charge may be applied with opposed electrostatic charging units within the FDU, with one of the electrostatic charging units located substantially closer to the diffusion chamber than the other electrostatic charging unit. In alternate embodiments, the electrostatic charge is applied to the fibers as the fibers are conveyed through the diffusion chamber, for example by opposed electrostatic charging units within the diffusion chamber.

DEFINITIONS

Figure 1:
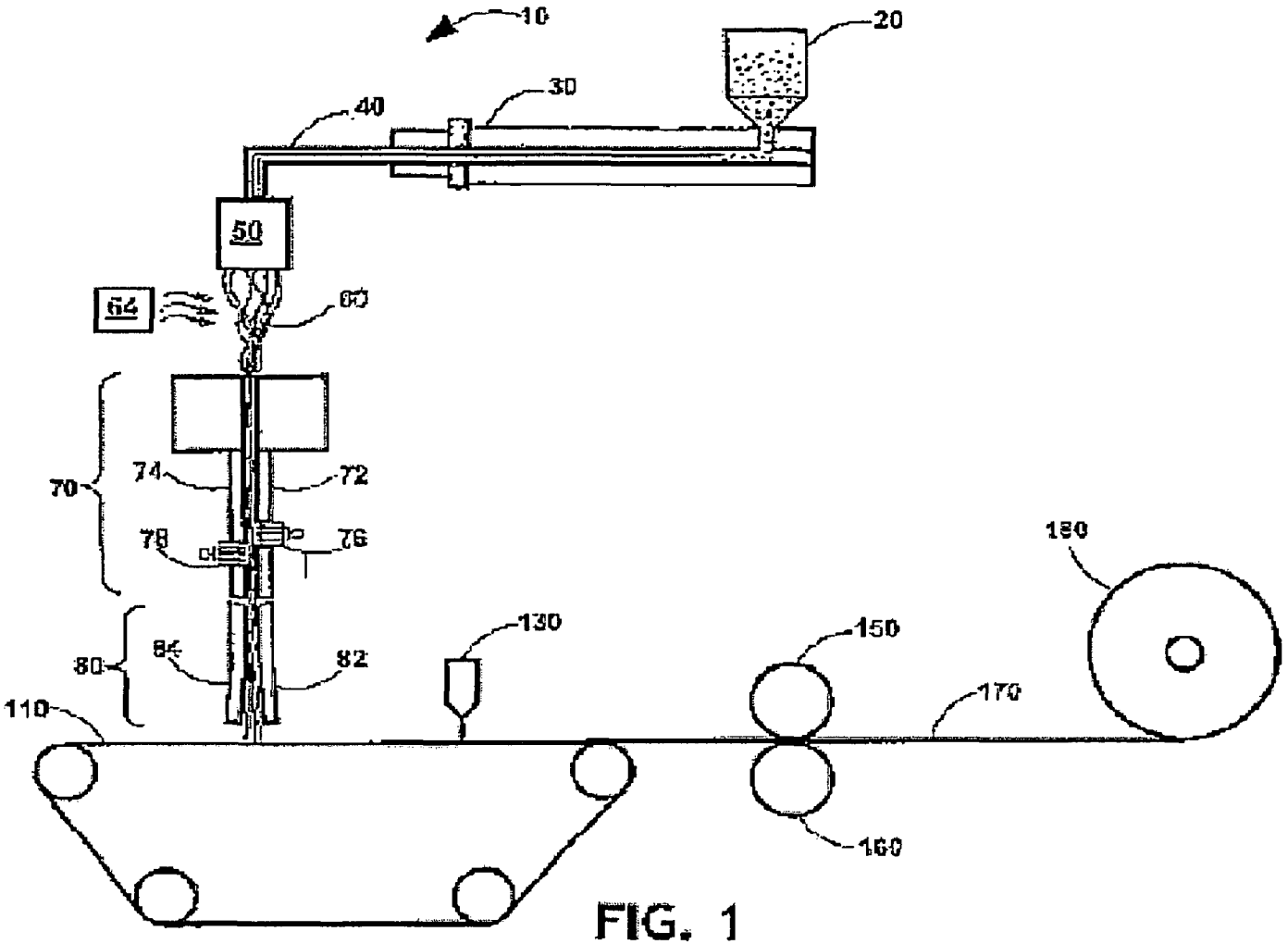
FIG. 1 (Prior Art)
FIG. 1 is a schematic illustration of an exemplary prior art process for producing nonwoven webs.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the chemical formula structure. These configurations include, but are not limited to isotactic, syndiotactic and random symmetries.

As used herein the term "fibers" refers to both staple length fibers and continuous fibers, unless otherwise indicated. The term "fiber bundle" refers to a grouping of individual fibers.

As used herein the term "nonwoven web" or "nonwoven material" means a web having a structure of individual fibers or filaments which are interlaid, but not in an identifiable manner as in a knitted or woven fabric. Nonwoven webs may be formed from many processes, such as, for example, melt-blowing processes, spunbonding processes, air-laying processes and carded web processes. The basis weight of nonwoven fabrics is usually expressed in grams per square meter (gsm) or ounces of material per square yard (osy), and the fiber diameters useful are usually expressed in microns.

The term "spunbond" or "spunbond nonwoven web" refers to a nonwoven fiber or filament material of small diameter fibers that are formed by extruding molten thermoplastic polymer as fibers from a plurality of capillaries of a spinneret. The extruded fibers are cooled while being drawn by an educative or other well-known drawing mechanism. The drawn fibers are deposited or laid onto a forming surface in a generally random manner to form a loosely entangled fiber web, and then the laid fiber web is subjected to a bonding process to impart physical integrity and dimensional stability. The production of spunbond fabrics is disclosed, for example, in U.S. Pat. No. 4,340,563 to Appel et al., U.S. Pat. No. 3,692,618 to Dorschner et al., and U.S. Pat. No. 3,802,817 to Matsuki et al. Typically, spunbond fibers or filaments have a weight-per-unit-length in excess of about 1 denier and up to about 6 denier or higher, although both finer and heavier spunbond fibers can be produced. In terms of fiber diameter, spunbond fibers often have an average diameter of larger than 7 microns, and more particularly between about 10 and about 25 microns, and up to about 30 microns or more.

DETAILED DESCRIPTION

Reference is now made to particular embodiments of the inventive method and apparatus according to the invention, one or more examples of which are illustrated in the figures. It should be appreciated that the embodiments are provided by way of explanation of the invention, and are not meant as a limitation of the invention. For example, features illustrated or described with respect to one embodiment may be used in another embodiment to yield still a further embodiment. The present invention encompasses these and other modifications and variations made to the embodiments described and illustrated herein.

FIG. 1 corresponds to FIG. 1 of the prior art PCT Publication No. WO 2005/045116 and is used herein to describe various conventional features of the present method and apparatus for forming a nonwoven web in a melt extrusion process. With reference to FIG. 1, a process line 10 is presented for production of monocomponent or multicomponent continuous fibers. The process line 10 is an open system and includes an extrusion device, such as the conventional extruder 30, for melting and extruding polymer fed from polymer hopper 20. The polymer is fed from extruder 30 through polymer conduit 40 to a spinneret 50 that forms fibers 60, which may be monocomponent or multicomponent fibers. Where multicomponent fibers are desired, a second extruder fed from a second polymer hopper would be used. The spinneret 50 has openings or capillaries arranged in one or more rows. The spinneret openings form a downwardly extending "curtain" or "bundle" of fibers 60 when polymer is extruded through the spinneret 50. Spinnerets 50 for extruding multicomponent continuous fibers are well known in the art and need not be described in detail herein detail. An exemplary spin pack for producing multicomponent fibers is described in U.S. Pat. No. 5,989,004 to Cook, which is incorporated herein in its entirety for all purposes.

Polymers suitable for the present invention include the known polymers suitable for production of nonwoven webs and materials such as for example polyolefins, polyesters, polyamides, polycarbonates and copolymers and blends thereof. It should be appreciated that the particular type of polymer is not a limiting feature.

The exemplary open process line 10 in FIG. 1 also includes a quench blower 64 positioned adjacent the curtain of fibers 60 extending from the spinneret 50. Air from the quench air blower 64 quenches the fibers 60 extending from the spinneret 50. The quench air can be directed from one side of the fiber curtain as shown in FIG. 1, or both sides of the fiber curtain. As used herein, the term "quench" simply means reducing the temperature of the fibers using a medium that is cooler than the fibers, such as, for example, chilled air streams, ambient temperature air streams, or slightly to moderately heated air streams.

An aspirator or "fiber drawing unit" (FDU) 70 is positioned spaced from and below the spinneret 50 to receive the quenched curtain or bundle of fibers. The function and operation of fiber drawing units for use in melt spinning polymers are well known in the art. Generally, the fiber drawing unit 70 includes an elongated vertical passage or drawing slot defined by parallel side walls of the FDU 70 through which the fibers are drawn by aspirating air entering generally from both of the sides of the drawing slot and flowing downwardly through the passage. The attenuation chamber or fiber drawing slot is formed by opposed plates or sidewalls, designated 72 and 74 in FIG. 1. In various prior art configurations, including that of FIG. 1, the opposed sidewalls 72 and 74 are substantially parallel to each other and generally perpendicular to a horizontal plane. The fiber drawing unit 70 utilizes a moving pneumatic stream, such as aspirating air supplied by a blower (not shown), to draw the fibers through the slot. The aspirating air may be heated or unheated. The aspirating air accelerates the fibers and applies an attenuating or drawing force on the fibers to reduce the diameter of the fibers. The aspirating air also acts to guide and pull the curtain or bundle of fibers through the drawing slot of the fiber drawing unit 70. The aspirating air may be heated, for example to activate latent helical crimp in multicomponent fibers prior to fiber laydown.

As the fibers exit the fiber drawing unit 70 they are passed through a diffusion chamber 80 to reduce the fiber velocity prior to laying the fibers down into a nonwoven web. Diffusion chambers or diffusers in general are disclosed in U.S. Pat. No. 5,814,349 to Geus et al., incorporated herein by reference in its entirety for all purposes. Other diffusion chamber configurations are described in U.S. Pat. Nos. 6,918,750 and 6,932,590 also to Geus et al. As described in U.S. Pat. No. 5,814,349, it is desirable for the diffuser to be mounted slightly below the exit of the fiber drawing unit to allow for ambient air to be drawn into the diffusion chamber from the sides.

Desirably, as shown in FIG. 1, diffusion chamber 80 is formed between the opposed diverging sidewalls 82 and 84. The opposed sidewalls 82 and 84 diverge outwardly toward the outlet of the chamber 80 in such a way that the volume of the chamber defined between the sidewalls expands towards the bottom end of the diffuser. Desirably, the opposed sidewalls 82 and 84 are substantially continuous and unvented, so that air from the jet of attenuation air does not escape from the walls of the diffusion chamber but rather exits the bottom of the diffusion chamber 80 after traveling therethrough. The gradually expanding or increasing volume of diffusion chamber 80 allows for the jet of fast-moving attenuation air to gradually expand into the increasing volume as it exits the fiber drawing unit 70 and passes through the diffusion chamber 80. The diverging sidewalls 82 and 84 may be substantially parallel to one another in the upper portion of the diffusion chamber 80 and are inclined or diverge at about a 5 degree angle from the vertical centerline of the chamber at the point where they begin to diverge from one another. The sidewalls of the diffusion chamber 80, and thus the angle of divergence, may be adjustable, and the angle of divergence may be much less than 5 degrees or may be greater than 5 degrees.

As the pneumatic jet expands in the diffusion chamber 80, it decreases in velocity, and the fiber velocity also decreases, which allows for the fiber bundle to spread out somewhat in the machine direction. That is, as the fiber bundle travels downward through the diffusion chamber, it begins to take on a machine direction dimension which is somewhat larger than it had at the outlet of the fiber drawing unit 70.

However, in order to provide for high uniformity of material formation on fiber laydown, it is highly desirable for the machine direction fiber bundle spread to be larger than the bundle spread generated by the diffusion chamber alone. In this regard, one or more electrostatic charging devices may be used to impart an electrostatic charge to the fibers of the fiber bundle either as they travel through the drawing slot of fiber drawing unit 70 or as they travel through diffusion chamber 80, or both. In FIG. 1, exemplary electrostatic charging units 76 and 78 are shown in opposed relationship located on opposed sidewalls 72 and 74 of the fiber drawing unit 70. Where opposed electrostatic charging units are utilized, they may be configured in an offset or staggered relationship such that one electrostatic charging unit is higher or lower than the other. For example, referring to FIG. 1, electrostatic charging unit 78 is mounted lower on its respective sidewall, i.e., closer to the diffusion chamber, than is electrostatic charging unit 76. Generally described, an electrostatic charging device, such as charging units 76, 78, may consist of one or more rows of electric emitter pins which produce a corona discharge, thereby imparting an electrostatic charge to the fibers, and the fibers, once charged, will tend to repel one another and help prevent groups of individual fibers from clumping or "roping" together. An exemplary process for charging fibers to produce nonwovens with improved fiber distribution is disclosed in PCT Pub. No. WO 02/52071 to Haynes et al. published Jul. 4, 2002, the disclosure of which is incorporated herein by reference in its entirety for all purposes. The function and operation of such electrostatic charging devices is well known in the art and need not be described in detail herein.

In still another embodiment to assist machine direction bundle spreading, it may be desirable to utilize one or more electrostatic charging units inside the diffusion chamber 80. For example, one or more electrostatic charging units may be located on the same diffusion chamber sidewall. It may also be desirable to have at least one electrostatic charging unit located on each sidewall of the diffusion chamber. Where electrostatic charging units are located on both sidewalls, they may be located substantially directly across from one another, that is, the electrostatic charging units may be located at substantially the same vertical height within diffusion chamber 80. It may also be advantageous to have the electrostatic charging units in the diffusion chamber located in a staggered configuration, similar to the staggered configuration described with respect to electrostatic charging units 76 and 78 in fiber drawing unit 70 in FIG. 1.

In still another embodiment, a single electrostatic charging unit may be used, in either the diffusion chamber or in the fiber drawing slot, in conjunction with specific application of aerodynamic forces to balance the repulsion forces created by the electrostatic charging unit. As an example, although it was stated above with reference to FIG. 1 that the fibers are drawn through the drawing slot of the fiber drawing unit by aspirating air entering generally from both sides of the passage, where an electrostatic charging unit is located only on one of the walls forming the drawing slot of the fiber drawing unit, the fiber bundle spread in the machine direction may be enhanced by utilizing attenuation air entering the fiber drawing unit only from the opposing sidewall of the fiber drawing slot.

FIGS. 2A through 2G illustrate aspects of a various fiber drawing units 270 in accordance with the method and apparatus of the present invention that may be utilized in the process line illustrated in FIG. 1, or other suitable process lines. It should be understood that the illustrations are schematic and grossly exaggerated in order to more clearly illustrate aspects of the invention.

Figure 2A:
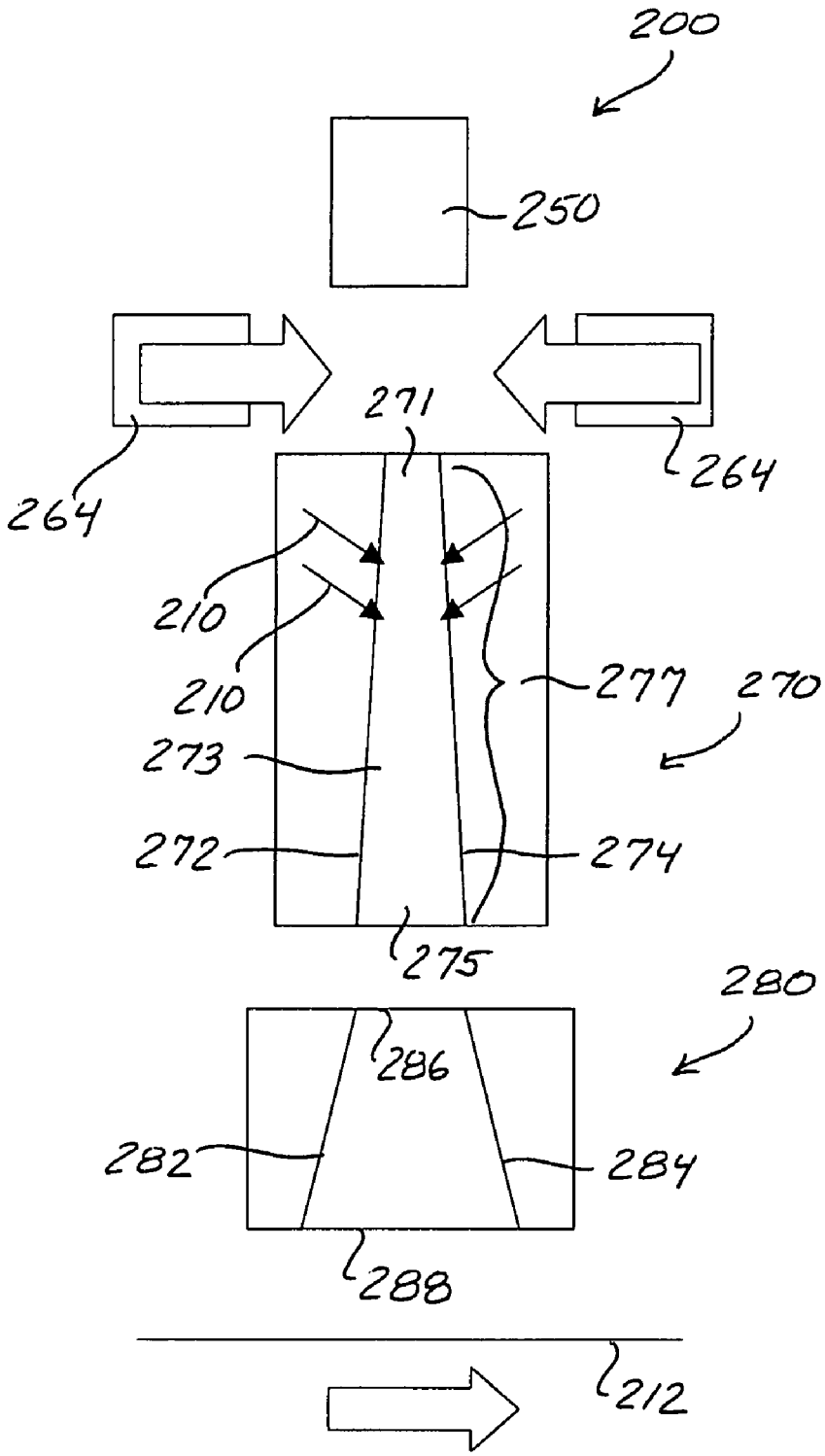
FIGS. 2A through 2G are schematic illustrations of various embodiments of fiber drawing units in accordance with aspects of the invention.

Referring to FIG. 2A, a process line 200 is illustrated with an extrusion device in the form of a spinneret 250 for forming individual fibers from a molten polymer, as described above. Dual quench air blowers 264 are provided at the outlet of the spinneret 250. A fiber draw unit (FDU) 270 having an inlet 271 and an outlet 275 receives the quenched fibers. Attenuating air (heated or unheated) is directed into the FDU 270 by any combination of nozzles, plenums, or jets 210 (referred to collectively as nozzles). In the illustrated embodiment, two nozzles 210 are provided at each wall 272, 274. These dual air nozzles are located at or very near to a point of divergence of the sidewalls 272, 274, as explained in greater detail below. It should be appreciated that any number, configuration, and location of nozzles 210 for supplying attenuating air within the FDU are within the scope and spirit of the invention.

To further enhance machine direction spreading of the fiber bundle, it may be desired to pertubate the air supplied by the nozzles 210, for example by pulsing or otherwise disturbing or disrupting the airstreams. This may be accomplished by the use of one or more mechanical valves that alternately pulse or modify the air flow fed to the nozzles 210. Such pertubation can be accomplished with single, dual, or other multiple arrangements of nozzles 210 within the respective walls 272, 274 of the FDU. Pertubation of drawing air is described in U.S. Pat. No. 5,807,795 to Lau et al., which is incorporated herein in its entirety for all purposes.

A diverging diffusion chamber 280 having an inlet 286 and an outlet 288, and symmetrically diverging walls 282 and 284 is disposed below the outlet 275 and functions as described above. The outlet 275 of the FDU 270 has a width generally equal to or less than the width of the inlet 286 to the diffusion chamber 280. The fibers exit the diffusion chamber 280 and are laid onto a traveling forming belt 212 (110 in FIG. 1) as a nonwoven web.

Still referring to FIG. 2A, the FDU 270 defines a drawing slot 273 that includes a diverging profile portion 277. In general the diverging profile portion is the longitudinal portion of the drawing slot 273 wherein the cross-sectional width of the slot 273 increases from a minimum to a maximum. In the particular embodiment of FIG. 2A, the diverging profile portion 277 corresponds generally to the entire length of the drawing slot 273, with the inlet 271 of the drawing slot defining the minimum width and the outlet 275 defining the maximum width. The diverging profile portion 277 in this embodiment has a generally constant angle of divergence defined by symmetrically diverging sidewalls 272 and 274. With respect to a longitudinal centerline of the drawing slot 273, the walls 272, 274 diverge equally over the length of the slot 273. As described above, the diverging profile portion 277 of the FDU causes the fibers conveyed through the drawing slot to open or expand in the machine direction prior to exiting the FDU outlet 275 and before entering the diffusion chamber 280. This initial machine direction spreading is believed to significantly enhance the function of the diffuser without detrimentally affecting the degree of attenuation within the FDU 270, thus having an insignificant impact on fiber size. The diverging profile portion 277 provides an improved nonwoven web and does not require increased energy (i.e., increased attenuating air pressure) to provide this benefit.

It should also be appreciated that, although the walls of the FDU 270 in FIGS. 2A through 2G are illustrated as straight (non-curved), the walls may be curved, or include a combination of curved and straight walls, to achieve the purposes of a diverging profile portion 277 of the drawing slot 273.

Figure 2B:
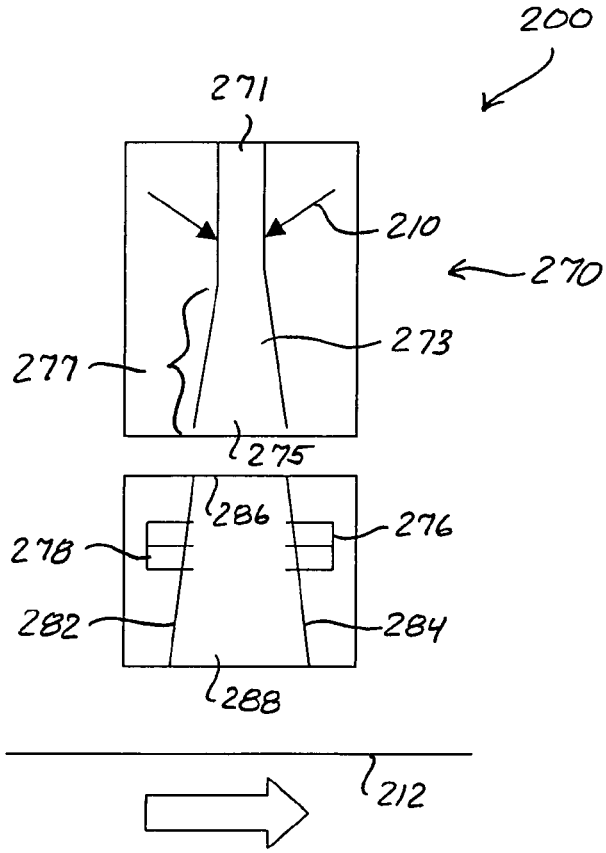

FIG. 2B illustrates an embodiment of an FDU 270 wherein the diverging profile portion 277 is less than the entire length of the drawing slot 273. In this embodiment, the sidewalls 272, 274 are essentially parallel from the inlet 271 to a downstream location within the FDU, at which point the walls 272, 274 diverge symmetrically to the outlet 275. Thus, the diverging profile portion 277 is preceded by an initial non-diverging portion of the drawing slot 273 defined by parallel sidewalls.

As with FIG. 2A, the diverging profile portion 277 of FIG. 2B is defined by generally continuously diverging wall portions (straight or curved). It should be appreciated that the diverging profile portion 277 may be defined by a non-continuous wall profile, such as a step profile. Various diverging profiles may be used to achieve the objects and function of the diverging profile portion 277 within the scope and spirit of the invention.

The processing line 200 of FIG. 2B also incorporates one or more electrostatic charging units 276, 278 within the diverging diffusion chamber 280, as discussed above. These units may be directly opposed as illustrated in the figure, or provided in a staggered configuration. Also, it should be understood that any one of the embodiments of FIGS. 2A through 2G may include any combination of charging units within the FDU 20, such as the units 276, 278 in FIG. 2C.

Figure 2C:
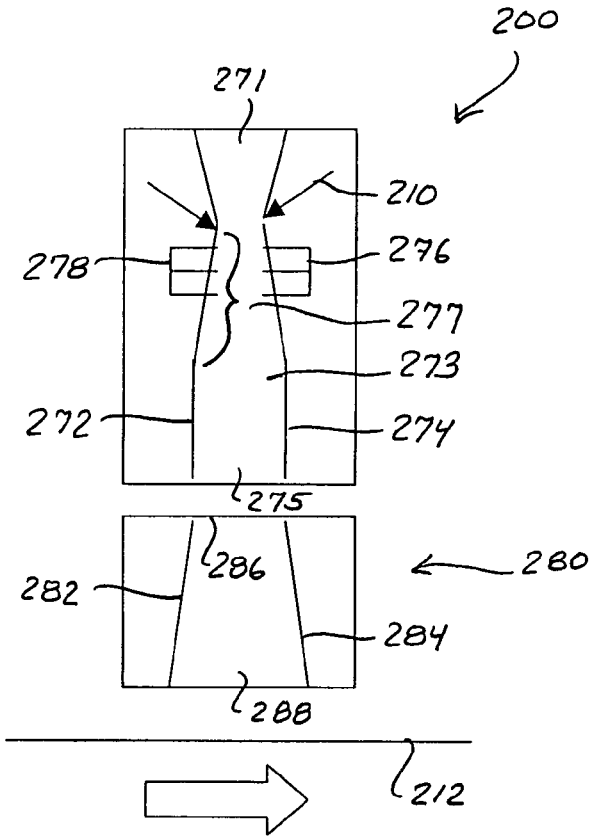

FIG. 2C illustrates an embodiment of an FDU 270 wherein the diverging profile portion 277 is preceded and followed by a non-diverging portion of the drawing slot 273. In this embodiment, the initial longitudinal portion of the drawing slot 273 that precedes the diverging portion has a converging profile such that the minimum width of the diverging profile portion 277 is defined at the point of maximum convergence of the initial portion. In essence, a nozzle is created by this unique profile that may function to accelerate the fibers before the fibers enter the diverging profile portion 277. The downstream non-diverging portion of the drawing slot 273 is defined by a parallel portion of the sidewalls 272, 274.

Figure 2D:
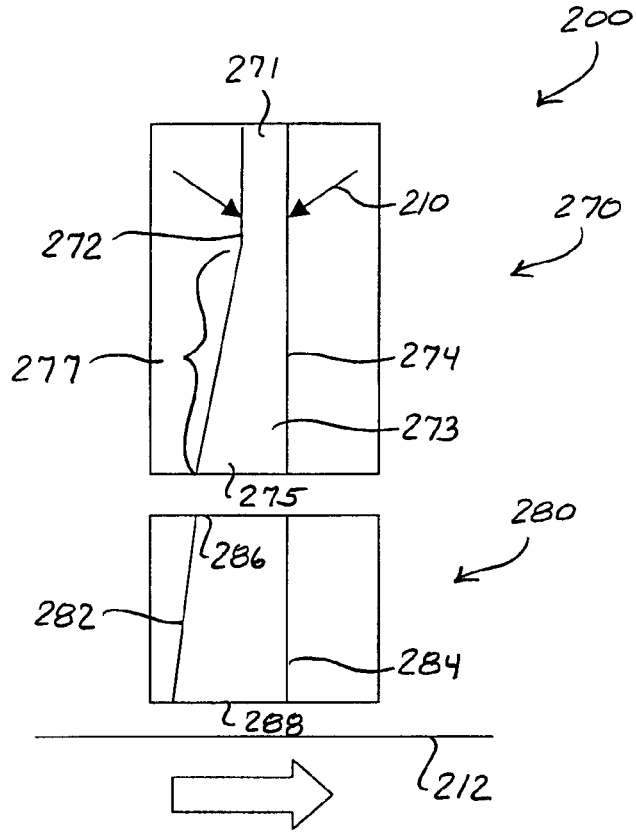

FIG. 2D illustrates an embodiment of an FDU 270 wherein the diverging profile portion 277 is defined by asymmetrically diverging sidewalls 272, 274. In this embodiment, the sidewall 274 is straight and essentially parallel to a longitudinal centerline of the drawing slot 273. The opposite sidewall 272 is parallel to the sidewall 274 in an upper portion of the slot 273, and then diverges to the outlet 275. The diverging profile of the diffusion chamber 280 is also defined by asymmetrically diverging sidewalls 282 and 284. In an alternate embodiment, the FDU 270 may have a asymmetrically diverging profile, with the diffusion chamber 280 having a symmetrically diverging profile.

Figure 2E:
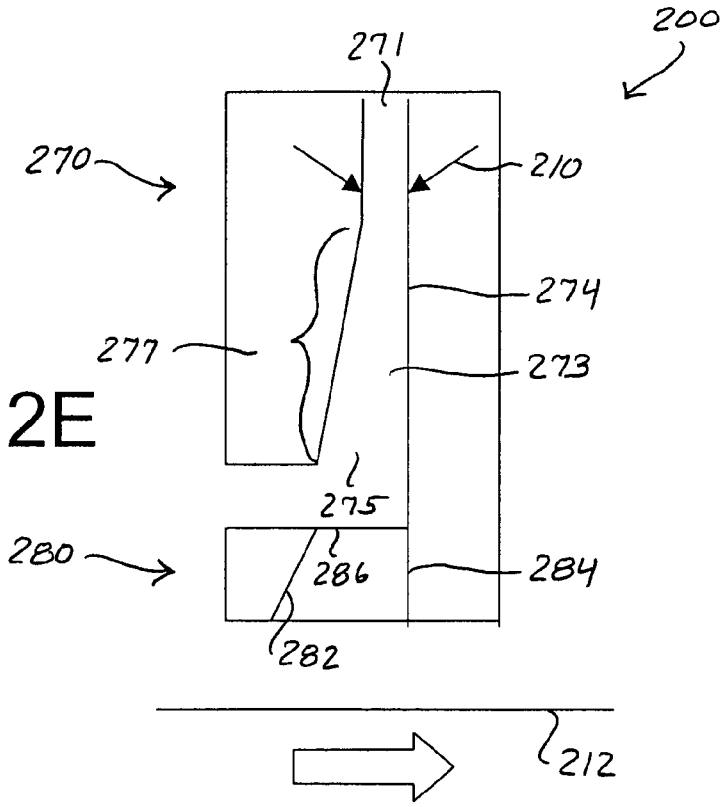

The embodiment of FIG. 2D is similar to that of FIG. 2E in that the sidewall 274 of the FDU 270 and sidewall 284 of the diffusion chamber 280 are straight. In this particular configuration, the sidewalls 274, 284 are disposed in the same plane, and may constitute a continuous wall. The inlet 286 of the diffusion chamber 280 is still spaced from the outlet 275 of the FDU 270 by the space between the sidewalls 272 and 282.

Figure 2F:
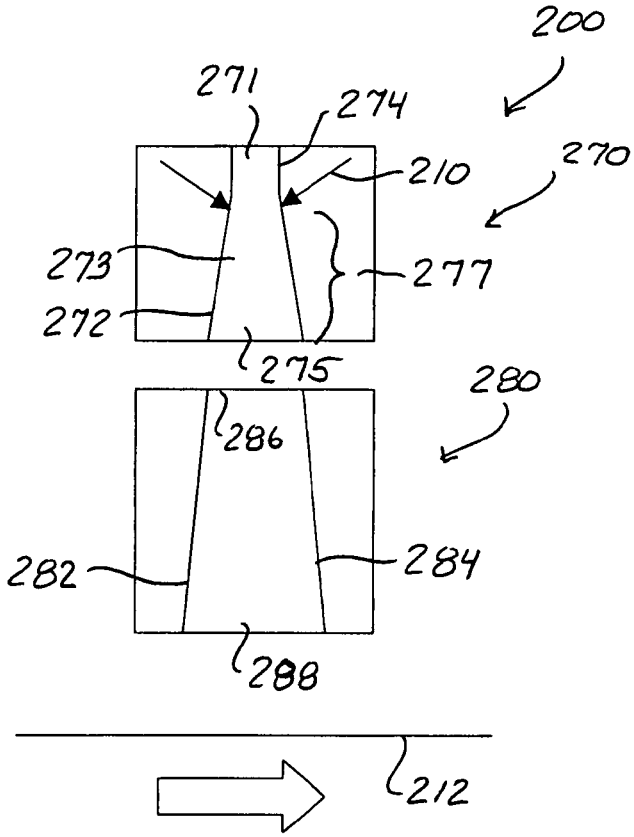

FIG. 2F illustrates an embodiment of a compact or "short" process line 200 wherein the FDU 270 shorter in the longitudinal dimension as compared to the other embodiments, yet still incorporates the diverging profile portion 277. In fact, the longitudinal length of the drawing slot 273 may be less than the longitudinal length of the diffusion chamber 280. It should be appreciated that the benefits of the present invention may be realized on various sizes and configurations of diffusion chambers and fiber drawing units, including symmetric and asymmetric diverging walls of the fiber drawing units and/or diffusion units.

Figure 2G:
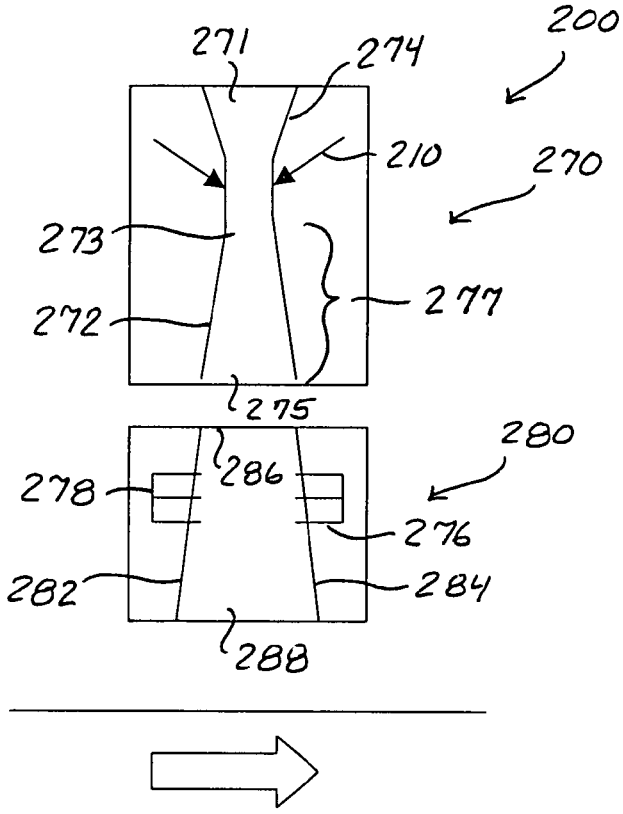

FIG. 2G illustrates an embodiment of an FDU 270 wherein the drawing slot 273 is defined by an initial converging section of the walls 272, 274, followed by a parallel section of the walls 272, 274. The parallel section merges into the diverging profile portion 277 defined by asymmetrically diverging sidewalls 272, 274. In the illustrated embodiment, the converging/parallel/diverging profile of the drawing slot 273 is symmetric with respect to a longitudinal centerline of the slot 273. It should be appreciated that any one or all of the different profile sections may be asymmetric as well.

In general, fiber drawing units may have an effective longitudinal length of the drawing slot of between about 10 inches to about 100 inches. A portion or the entire length of the drawing slot may diverge within the scope and spirit of the invention. The magnitude of divergence will thus depend on the length and divergence angle of the sidewalls, and can be readily empirically determined by those skilled in the art as a function of processing parameters. Although not meant as a limitation of the invention, it is believed that, with certain embodiments, the diverging profile portion should have an inlet width of from about 0.125 to about 0.60 inches, and that the outlet width of the divergence portion should be less than about 1.0 inches. In alternate embodiments, the total inclusive divergence angle (from one sidewall to the opposite sidewall) may vary within a range up to about 5 degrees, or greater.

Figure 3:
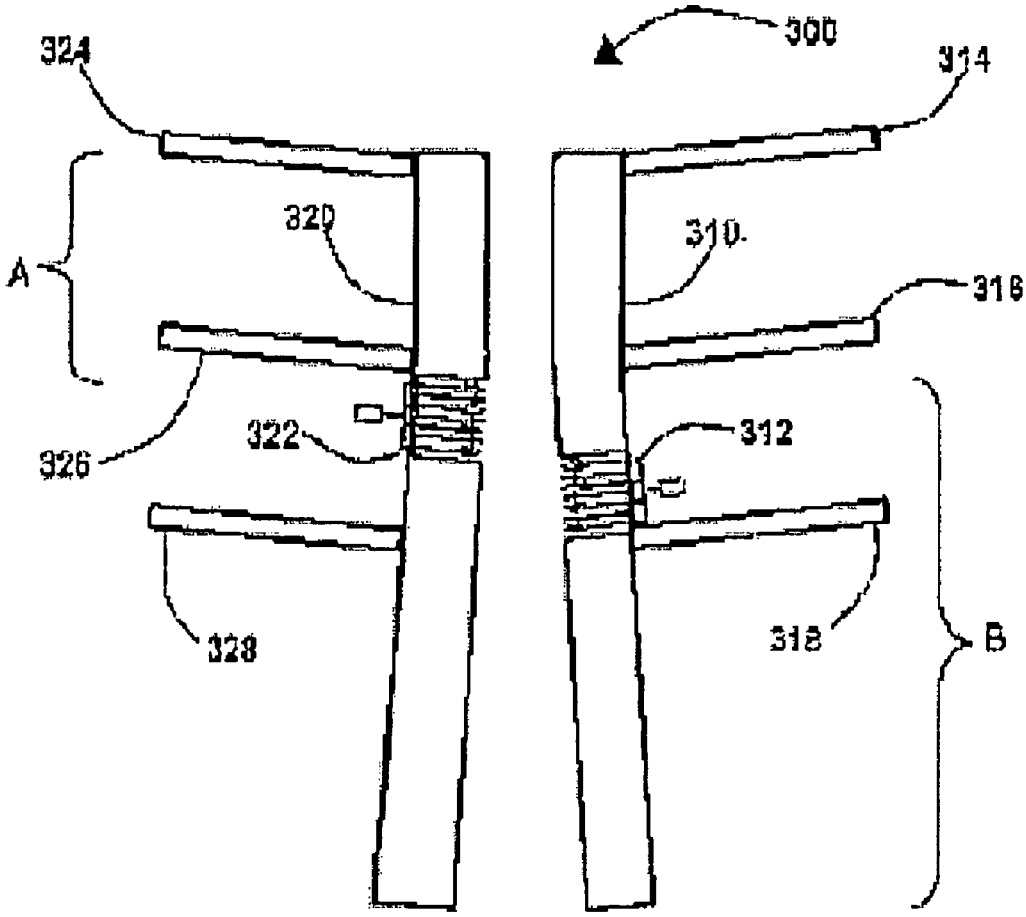
FIG. 3 (Prior Art)
FIG. 3 is a schematic illustration of an exemplary prior art diffusion chamber configuration.

FIG. 3 (also from the PCT Pub. No. WO 2005/045116) illustrates an exemplary diverging diffusion chamber 300 bounded by generally opposed sidewalls 310 and 320. Located within each sidewall 310 and 320, respectively, is electrostatic charging unit 312 and 322. The electrostatic charging units 312 and 322 are arranged in a staggered pattern or offset configuration such that the unit 322 would be located closer to the drawing slot of the fiber drawing unit 70 (FIG. 1) than electrostatic charging unit 312. In an alternate embodiment, the charging units 312, 322 may be located directly across from one another. Also, where three or more electrostatic charging units are used, they may continue the staggered pattern of FIG. 2, or may be configured such that certain of the electrostatic charging units are located directly across from one another while other electrostatic charging units are located in a staggered pattern.

Still referring to FIG. 3, the sidewalls of the diffusion chamber may be capable of adjustment, as is shown by adjusting rods 314, 316 and 318 attached to sidewall 310 and adjusting rods 324, 326 and 328 attached to sidewall 320. By manipulation of the adjusting rods, it is possible to configure the diffusion chamber 300 such that the sidewalls 310 and 320 are substantially parallel to one another for a certain vertical portion of the diffuser (the region of the diffuser marked by bracket A) before beginning to slope outward or diverge from one another in the region of the diffuser marked by bracket B. Also, it is possible to cause the entire length of sidewalls 310 and 320 to diverge from one another along their entire lengths. Other configurations are possible and may be desirable depending on process variables such as rate of fiber production and amount of drawing air to be conducted through the diffusion chamber. For example, it may be desirable to have sidewalls 310 and 320 converge very slightly prior to divergence, producing the cross section of a venturi nozzle or throat.

Returning to FIG. 1, also shown is an endless foraminous forming surface such as belt 110 which is positioned below the fiber drawing unit 70 and the diffusion chamber 80 to receive the attenuated fibers 100 from the outlet opening of the diffusion chamber 80. A vacuum source (not shown) positioned below the foraminous forming surface 110 may be beneficially employed to pull the attenuated fibers onto foraminous forming surface 110. The fibers received onto foraminous forming surface 110 comprise a nonwoven web of loose continuous fibers, which may desirably be initially consolidated using consolidation means 130 to assist in transferring the web to a bonding device. Consolidation means 130 may be a mechanical compaction roll as is known in the art, or may be an air knife blowing heated air onto and through the web as is described in U.S. Pat. No. 5,707,468 to Arnold, et al., incorporated herein by reference in its entirety.

The process line 10 further includes a bonding device such as the calender rolls 150 and 160 shown in FIG. 1, which may be used to thermally point-bond or spot-bond the nonwoven web as described above. Alternatively, where the fibers are multicomponent fibers having component polymers with differing melting points, through-air bonders such as are well known to those skilled in the art may be advantageously utilized. Generally speaking, a through-air bonder directs a stream of heated air through the web of continuous multicomponent fibers thereby forming inter-fiber bonds by desirably utilizing heated air having a temperature at or above the polymer melting temperature of the lower melting polymer component and below the melting temperature of higher melting polymer component. The web may be bonded by utilizing other means known in the art, such as adhesive bonding means, ultrasonic bonding means or entanglement means such as hydroentangling or needling.

Lastly, the process line 10 further includes a winding roll 180 for taking up the bonded web 170. While not shown here, various additional potential processing and/or finishing steps known in the art such as web slitting, stretching, treating, or lamination of the nonwoven fabric into a composite with other materials, such as films or other nonwoven layers, may be performed without departing from the spirit and scope of the invention.

In still another embodiment, the uniformity of the nonwoven web formation may be further improved or enhanced by utilizing vortex generators on or near the inner surface of the diverging sidewalls of the diffusion chamber. Vortex generators may be placed along one or more walls at spaced apart locations across the cross machine direction of the sidewall, to induce vortices into the airstream. The vortices induced will act to increase turbulence in the inner layer of the airstream close to the sidewall, adding energy to the flow in that area, and reduce flow separation, allowing for the airstream to more effectively conform to the sidewalls as the sidewalls diverge, and thus providing for a more complete machine direction dispersion of the airstream and consequently a larger machine direction fiber bundle spread. Vortices may be generated by having tabs or protrusions on one or more sidewalls at spaced apart locations, such as are described in U.S. Pat. No. 5,695,377 to Triebes et al., incorporated herein by reference in its entirety. Depending on placement of the vortex generators and amount of machine direction fiber bundle spread inside the diffusion chamber, catching or dragging of the fibers upon the vortex generators may be an issue. In that instance, it may be desirable to utilize as vortex generators dimples or inverted tabs which extend into the surface of the material forming the sidewall, rather than vortex generators which extend outwardly from the inner surface of the sidewall into the diffusion chamber.

Other methods of vortex generation may be employed with or in place of those described above. For example, one or more backward facing steps running substantially in the cross-machine direction width of the diffusion chamber may be used on the inner sidewall surface to generate vortices. As another example, air jets may be used on one or both sidewalls of the diffusion chamber at or near the point of divergence to generate vortices by blowing fine jets of a fluid such as air through pores or holes drilled or otherwise formed in the sidewall surface material. As an alternative to actual air jets, synthetic jets such as are generally described in U.S. Pat. No. 5,988,522 to Glezer et al., incorporated herein by reference in its entirety, may be used on one or both sidewalls to generate vortices. Generally described, a synthetic jet may be produced from a fluid-filled chamber having a flexible actuatable membrane at one end and a more rigid wall at the other end, the rigid wall having a small hole. The flexible membrane may then be repeatedly actuated by acoustical wave energy, mechanical energy or piezoelectric energy, thereby causing a jet of fluid (such as air) to emanate from the hole in the more rigid wall at the other end of the chamber.

The following example is provided for illustration purposes and the invention is not limited thereto.

EXAMPLE

Example spunbond nonwoven materials were produced using commercially available isotactic polypropylene of approximately 35 melt flow rate, available from ExxonMobil Chemical Co. (Houston, Tex.) and designated as Exxon 3155. All materials were produced using a spunbond type slot-draw nonwoven spinning system such as described in the above-mentioned U.S. Pat. No. 3,802,817 to Matsuki et al. and, after being collected on a forming surface, all materials were thermally bonded using a heated calendar roll. For all the materials, an electrostatic charging system was located near the drawing slot exit of the fiber drawing unit to charge the filament curtain, as generally described in the PCT Pub. No. WO 2005/045116 cited above, wherein the fibers were subjected to an applied electrostatic charge before the fibers entered the diffusion chamber.

Also for the production of the Example materials, a diffusion chamber substantially as described in U.S. Pat. No. 5,814,349 to Geus et al. and as generally described above (except that no electrostatic charging units were located within the diffuser) was located below the fiber drawing unit drawing slot. The diffusion chamber was mounted slightly lower than the exit of the fiber drawing unit to allow for air to be drawn into the diffusion chamber. The diffusion chamber was set up using control rods to produce a venturi shape, with the sidewalls initially converging before diverging out at the bottom or exit of the diffusion chamber.

The control samples (STRAIGHT FDU) were produced using a Fiber Drawing Unit (FDU) with parallel sidewalls that established an entrance opening and an exit opening on the FDU of the same dimension. The example materials (DIVERGING FDU) were produced using a FDU with diverging sidewalls that established an exit opening greater than the entrance opening dimension. One set of example materials was produced using an electrostatic charging system to impart a charge on the fibers. For all materials, the spinning and drawing conditions were held constant. The polymer throughput rate, the fiber drawing rates were held constant thereby resulting in the same fiber size. For all materials, the fibers had an average diameter of about 18 microns (about 2.0 denier).

The formed nonwoven webs were tested for Air Permeability according to the ASTM D737 test method, and using a TEXTEST FX 3300 Air Permeability tester available from the Schmid Corp. (Spartanburg, S.C.). The materials were tested for air permeability and the results of fifteen repetitions for each sample were averaged for each material. The permeability results measured in CFM (cubic feet per minute) are shown in TABLE I below.

TABLE 1

| Air Permeability (CFM) | | | | |
|---|---|---|---|---|
| | Straight FDU | | Diverging FDU | |
| Electrostatic Charging | No | Yes | No | Yes |
| Permeability | 1060.8 | 1011.7 | 925.9 | 905.4 |
| Std Dev | 57.1 | 61.7 | 46.7 | 65.7 |
| Number of samples | 15 | 15 | 15 | 15 |

In the present Example, air permeability is a measure of airflow through the Spunbond Web. Higher numbers indicate a lower pressure drop. Pressure drop is a direct indicator of web formation. Better formation materials have smaller pore structure, which causes the pressure drop to increase. Therefore better formation is indicated by lower Permeability values. The data in Table 1 shows that the permeability values for the diverging FDU samples are ~11% to 13% lower than the comparative materials. All materials listed in TABLE were the same basis weight, about 0.50 osy (about 17 gsm), and were produced at the same polymer throughput rate, of about 10.6 PIH (about 190 kg/meter/hour). The results indicate that, with all other parameters being essentially constant, the diverging FDU produces a better-formed web.

What is claimed is:

1. An open system apparatus for forming a nonwoven web comprising: an extrusion device that provides a plurality of polymer fibers; an open system fiber draw unit (FDU) disposed to receive the plurality of polymer fibers from said extrusion device, said FDU including a drawing slot in which the polymer fibers are attenuated, said drawing slot having an inlet and an outlet defined by spaced apart walls; at least a longitudinal portion of said drawing slot comprising a diverging profile in a direction of fiber conveyance through said FDU, the polymer fibers spreading in a machine direction as they are conveyed through said diverging profile portion of said FDU; a diverging diffusion chamber spaced from said outlet of said FDU; at least one electrostatic charge unit configured to apply an electrostatic charge to the fibers in either said diffusion chamber or said FDU; a moving forming surface below said diffusion chamber on which the polymer fibers are collected; at least one air nozzle configured within said FDU; and means positioned in an air flow fed to said air nozzle for perturbating the attenuating air supplied from said air nozzle, before the air exits said nozzle, in order to disturb or disrupt the air flow from said nozzle to further enhance machine direction spreading of the plurality of polymer fibers via agitation of the air flow and polymer fibers; wherein said diverging profile portion of said FDU drawing slot has an inlet width of about 0.125 to about 0.60 inches, and an outlet width greater than said inlet width and less than about 1.0 inch.

2. The apparatus as in claim 1, wherein said electrostatic charging unit is configured within said FDU to apply the electrostatic charge as the fibers are conveyed through said drawing slot.

3. The apparatus as in claim 2, comprising opposed electrostatic charging units within said FDU, at least one said electrostatic charging units located substantially closer to said diffusion chamber than at least one other said electrostatic charging unit.

4. The apparatus as in claim 1, wherein said electrostatic charging unit is configured within said diffusion chamber.

5. The apparatus as in claim 4, comprising opposed electrostatic charging units within said diffusion chamber.

6. The apparatus as in claim 1, wherein said diverging diffusion chamber is defined by opposed symmetrically diverging sidewalls.

7. The apparatus as in claim 1, wherein said diverging diffusion chamber is defined by asymmetrically diverging sidewalls.

8. The apparatus as in claim 1, wherein said diverging profile portion of said FDU drawing slot is defined by symmetrically diverging sidewalls.

9. The apparatus as in claim 1, wherein said diverging profile portion of said FDU drawing slot is defined by asymmetrically diverging sidewalls.

10. The apparatus as in claim 1, wherein said diverging profile portion of said FDU drawing slot diverges substantially continuously between said drawing slot inlet and said drawing slot outlet.

11. The apparatus as in claim 1, wherein said diverging profile portion of said FDU drawing slot diverges discontinuously.

12. The apparatus as in claim 1, wherein said FDU drawing slot comprises an upstream non-diverging portion adjacent said diverging profile portion.

13. The apparatus as in claim 12, wherein said non-diverging portion is defined by substantially parallel sidewalls.

14. The apparatus as in claim 12, wherein said non-diverging portion is defined by converging sidewalls.

15. The apparatus as in claim 1, further comprising at least one air nozzle configured within said FDU to supply attenuating air to said diverging profile portion of said FDU drawing slot.

16. The apparatus as claim 1, wherein said FDU has a longitudinal length less than a longitudinal length of said diffusion chamber.

17. The apparatus as claim 1, wherein said FDU has a longitudinal length less than a longitudinal length of said diffusion chamber.

18. The apparatus as in claim 1, wherein said diverging profile portion of said FDU drawing slot has a total inclusive divergence angle of up to about 5 degrees.

19. An open system apparatus for forming a nonwoven web comprising:

an extrusion device that provides a plurality of polymer fibers; an open system fiber draw unit (FDU) disposed to receive the plurality of polymer fibers from said extrusion device, said FDU including a drawing slot in which the polymer fibers are attenuated, said drawing slot having an inlet and an outlet defined by spaced apart walls; and at least a longitudinal portion of said drawing slot comprising a diverging profile in a direction of fiber conveyance through said FDU, the polymer fibers spreading in a machine direction as they are conveyed through said diverging profile portion of said FDU; a moving forming surface on which the polymer fibers are collected as a web; at least one air nozzle configured within said FDU to supply attenuating air to said diverging profile portion of said FDU drawing slot and; means positioned in an air flow fed to said air nozzle for perturbating the attenuating air supplied from said at least one air nozzle, before the air exits said nozzle, in order to disturb or disrupt the air flow from said nozzle to further enhance machine direction spreading of the plurality of polymer fibers via agitation of the air flow and polymer fibers; wherein said diverging profile portion of said FDU drawing slot has a total inclusive divergence angle of up to about 5 degrees.

* * * * *